US007494624B2

(12) United States Patent
Crudace et al.

(10) Patent No.: US 7,494,624 B2
(45) Date of Patent: Feb. 24, 2009

(54) GAS GENERATOR

(75) Inventors: Amanda Jayne Crudace, West Wickham (GB); Stephen Robert Green, Milton Keynes (GB)

(73) Assignee: Molecular Oxygen Limited, Essex (GB)

( * ) Notice: Subject to any disclaimer, the term of this patent is extended or adjusted under 35 U.S.C. 154(b) by 109 days.

(21) Appl. No.: 10/528,085

(22) PCT Filed: Sep. 15, 2003

(86) PCT No.: PCT/GB03/04072

§ 371 (c)(1),
(2), (4) Date: Sep. 26, 2005

(87) PCT Pub. No.: WO2004/024239

PCT Pub. Date: Mar. 25, 2004

(65) Prior Publication Data

US 2006/0051255 A1 Mar. 9, 2006

(30) Foreign Application Priority Data

Sep. 16, 2002 (GB) ..... 0221451.8

(51) Int. Cl.
*A62B 7/08* (2006.01)

(52) U.S. Cl. ..... 422/120

(58) Field of Classification Search ..... 422/120
See application file for complete search history.

(56) References Cited

U.S. PATENT DOCUMENTS

| | | | | |
|---|---|---|---|---|
| 3,516,797 | A * | 6/1970 | Bovard et al. | 422/120 |
| 3,785,334 | A * | 1/1974 | Waldeck | 116/106 |
| 4,517,994 | A * | 5/1985 | Endelson | 131/329 |
| 5,338,516 | A * | 8/1994 | Zhang et al. | 422/126 |
| 5,725,834 | A * | 3/1998 | Nishii et al. | 422/126 |

FOREIGN PATENT DOCUMENTS

| | | |
|---|---|---|
| CN | CH 180448 | 10/1935 |
| EP | 0363913 | 4/1990 |
| GB | 1 341 869 | 12/1973 |
| WO | WO 96/38376 | 12/1996 |
| WO | WO 00/43071 | 7/2000 |
| WO | WO 02/098512 | 12/2002 |

* cited by examiner

*Primary Examiner*—Walter D Griffin
*Assistant Examiner*—Shanta G Doe

(57) ABSTRACT

A gas generator insulated by a vacuum-jacket vessel.

12 Claims, 5 Drawing Sheets

GAS GENERATOR

This invention relates to gas generators, more especially oxygen generators, and in particular to a generator for providing breathable oxygen.

Oxygen is generated on an industrial scale by numerous different methods. These include isolation of molecular oxygen from air and decomposition of water by, for example, electrolytic means. On an industrial scale, however, these methods require substantial capital investment, and the resulting plant is large, heavy, and immobile.

On a commercial scale, for providing breathable oxygen by portable means, oxygen is generally supplied from an oxygen cylinder, i.e., the oxygen is stored in molecular form, or generated on demand by a chemical reaction, a term used herein to exclude electrolytic decomposition and other methods in which generation requires an external source of energy.

Breathable oxygen generation by a chemical reaction has been known for a very long time, and portable oxygen candles are articles of commerce. A typical candle comprises an oxygen-containing chemical, for example an alkali metal chlorate or perchlorate, in admixture with a catalyst that facilitates lower temperature decomposition of the chemical to oxygen and residual solids and optionally a fuel, for example iron. A typical catalyst is manganese dioxide, which reduces the temperature at which potassium chlorate decomposes from about 400° C. to below about 240° C.

However, the overall reaction is exothermic, and the exterior of the reaction mass generally reaches very high temperatures, of the order of 600° C. or more. Considerable efforts have been made to provide portable devices that can safely be held by the user during operation despite the high temperatures reached during the reaction.

A number of thermally insulated devices are described in U.S. Pat. No. 5,725,834 (Nishii et al, assigned to Daicel Chemical Industries, Ltd.). The patent describes a prior art device in which silica is used as thermal insulation, which has the dual function of maintaining the exterior of the housing at an acceptably low temperature and maintaining the interior of the candle at a high enough temperature to ensure decomposition of all contained materials, to maximize oxygen output. In one embodiment of the Nishii invention itself, a cylindrical candle is surrounded by porous solid insulation within a copper jacket which is separated by an annular air space from the housing. The oxygen generated passes through the insulation to an outlet of the device at the head of the cylinder. In other embodiments there are more coaxial airspaces and the generated oxygen traces a convoluted passage through them, ensuring that it is cooled before reaching the user, and that the outer surface of the housing does not get too hot. All these measures, while being effective, inevitably add bulk and weight to the device.

There accordingly remains a need for an insulated gas generator the thermal insulation of which may result in apparatus that is lighter and/or less bulky than existing apparatus.

The present invention provides a chemical gas generator comprising a generating device for producing gas by chemical reaction, the device being at least partly enclosed within thermal insulating means comprising a vacuum jacket.

Advantageously, the gas generated is oxygen, and for simplicity will be referred to as such in much of the discussion below. The invention is, however, applicable to generators of other gases.

The generator is typically generally in the form of a cylinder, referred to hereinafter as a candle. The candle may be a cast body or a loose-filled or compacted powder, pelletized, or granular material. The candle advantageously comprises a metal chlorate or perchlorate, preferably an alkali metal, especially sodium or lithium, chlorate or perchlorate, in admixture with a catalyst, especially manganese dioxide, and a fuel, for example a metal, especially iron or magnesium. The candle is provided with ignition means, which may be electrically powered or mechanically driven, or operated by percussion cap or chemical reaction. The ignition means may be at one end of the candle or generally centrally located to provide two burn fronts travelling in different directions, preferably opposite directions towards the ends of the candle. The invention accordingly also provides an oxygen generator in which the generating device comprises:

(a) generating means for chemically generating oxygen when ignited and (b) ignition means for igniting the generating means, the generating means being arranged to sustain during operation propagation of a plurality of, preferably two, burn fronts therethrough, the fronts propagating in generally different, preferably opposite, directions, the device being at least partly enclosed within thermal insulating means comprising a vacuum jacket.

A burn front is the interface region bounded by unburnt and burnt regions of the generating means, and in operation travels towards the unburnt region.

The provision of the ignition means at a central region of the candle has the advantage that the ignition site, which becomes the hottest part of the candle, is remote from reusable parts of the generator. Further, the use of two or more burn fronts dissipates the heat generated over a wider area and assists in the control of the burn process.

The oxygen generating means may, for example, comprise at least one first element positioned and arranged for ignition by the igniting means, and a plurality of second elements each positioned and arranged for ignition by a first element, so that in operation a plurality of burn fronts is propagated through the at least one first element and through the plurality of second elements, the direction of propagation of one of the burn fronts differing from the direction of propagation of at least one other of the burn fronts.

The ignition means may, for example, be located in the central region of an oxygen generator of a generally cylindrical shape, the length of the generator being greater than its diameter so that in operation two burn fronts are propagated from the central region toward opposite ends of the generator. In this case also, there are preferably provided at least one first element of the generating means arranged for ignition by the ignition means and a plurality of second elements for ignition by a first element. There may be a succession of elements extending toward one or preferably both ends of the generator, each arranged for ignition by the immediately preceding element.

Whether the ignition means is at one end or centrally located, elements adjacent to and closer to the ignition means are advantageously more reactive, i.e., contain a greater proportion of fuel, e.g., iron, than elements more remote from it, to improve stability of the candle and render it less susceptible to accidental ignition. The most remote element may, if desired, contain no fuel, it having been found that this provides a lower maximum external temperature after reaction is complete. Step-wise gradation of the elements facilitates manufacture, as each element has a uniform composition, and the candle is then assembled from discrete components. The interfaces between elements may be of conical or frusto-conical form, assisting in control of burn front propagation between adjacent elements.

The ignition means may be, for example, an electrically resistive heating device, a percussion cap detonator or a cartridge ignition device, or an exothermic chemical reaction, initiated, for example, by causing or allowing contact between previously separated reagents. If desired, the candle may include more than one type of ignition device.

Electrically resistive heating devices have the advantage of being intrinsically safe until energized. When the ignition means comprises a resistive heating device, the generator advantageously further comprises electronic control means for controlling electrical power applied to the heating device to initiate combustion. Use of electronic control means enables an improved degree of ignition control to be achieved. The control means preferably includes coupling means for inductively coupling electrical power from the control means to the heating device; such inductive coupling is of benefit in that exposed electrical contacts may be avoided in the generator, such contacts being susceptible to oxidation and being potentially unreliable.

To conserve battery power and yet ensure reliable ignition of the generating means, the control means may include timing means for automatically controlling the period during which electrical power is applied to the heating device for initiating combustion.

When electrical or electronic ignition is employed, the control means advantageously includes at least one, preferably more than one, battery providing power for the ignition means to initiate oxygen generation, the control means further comprising battery monitoring means for monitoring remaining power deliverable from the at least one battery. The monitoring means indicates to a user the status of the battery needs.

The monitoring means advantageously includes a light emitting diode indicator and/or a liquid crystal display indicator for indicating remaining power deliverable from the battery or batteries. Light emitting diode indicators are more visible in subdued lighting, for example at dusk or night-time, whereas liquid crystal display indicators are more visible in strong illumination, for example in bright sunlight.

More details of a gas generator having these features are given in International Patent Application No. PCT/GB02/02603.

Other electrically powered ignition means include means for electrically generating a spark, e.g., by piezo-electric generation.

Preferably, however, the ignition means is mechanically operable and more especially comprises a means for generating a spark as, for example, a friction-generated spark. For friction-induced generation of sparks there may be mentioned, for example, contact of a friction wheel or other friction member with a flint, e.g., a cerium-iron alloy.

Advantageously, especially when spark ignition is used, the composition of the element of the oxygen-generating means in which, in use, ignition takes place, e.g., by contact with the spark, is extremely reactive. It may contain, for example, in addition to the main candle material, for example, the chlorate or perchlorate and fuel, a strong oxidizing agent, for example, manganese dioxide, or, especially, a permanganate, e.g., potassium permanganate. Advantageous ranges of proportions in the ignition region of the candle may be, for example, sodium chlorate up to 70%, fuel, e.g., iron, up to 50%, and oxidizing agent up to 50%, the percentages being by weight of the total composition.

Advantageously, there are provided when spark-induced generation is used means for abrading the part of the surface of the element of the generating device to be ignited, preferably immediately before ignition. Such abrasion ensures that any surface changes that might take place during storage do not result in inhibition of ignition and, more importantly, that loosened material, for example in the form of small particles, e.g. dust, is available for ignition by the spark. The abrasion means may be, for example, in the case where a friction member is used to generate the spark, the friction member itself or, advantageously, an associated member that is actuated when the friction member is actuated. Advantageously, in its rest position the means for abrading the element surface to be ignited is not in contact with the surface and is moved into contact only when the friction member is actuated. When the ignition region is firmly compacted, as in preferred embodiments of the invention, it tends to be resistant to ignition by sparking. This, especially when in combination with the abrasion means being, when in the storage position, out of contact with the candle, makes for additional safety in storage and transport.

Advantageously, especially when the means for igniting the candle is a spark generating means, and more especially when it is located to provide two burn fronts, as described above, the candle is a cylinder of a section other than circular, and advantageously has a cross-section in the form of a major segment of a circle. The ignition means is then advantageously positioned close or adjacent to the flat surface (chord) of the cylinder, so that in operation the spark is directed at a flat surface of the candle. The portion of the cylinder having the cross-section of the corresponding minor segment of the circle advantageously contains means for actuating the ignition means, preferably extending to a location outside the vacuum jacket, and a conduit for transporting oxygen to a user, the conduit advantageously including filter means. The oxygen conduit, filter means, and actuating means advantageously form or are contained in a cylindrical unit having the cross-section of the corresponding minor segment of the circle. The unit advantageously is apertured in its flat surface (chord) to allow contact of the abrading means with and transmission of the spark to the candle, and transmission of oxygen to the conduit.

Advantageously, the means for actuating the ignition means comprises a rotatable shaft on which the friction member is and if present its associated abrasion member are mounted. The shaft also carries, advantageously remote from the ignition means, means for rotating the shaft, for example a gear means driven directly or indirectly by handle means. Operation of the handle means may actuate the ignition means directly but advantageously, to ensure uniformity of actuation, actuation is indirect, for example by the handle deforming spring means, disengagement of the handle causing or allowing the spring means to actuate the ignition means. Actuation may take place, for example, by gear means associated with the spring means rotating the shaft by way of the gear means carried on the shaft.

In certain embodiments, the candle is advantageously provided with an apertured, for example perforated, casing, for example, of gauze, of a material, preferably a metal, of high thermal conductivity, for example copper or brass, in good thermal contact with the candle material. The casing transmits heat from the burn front and the burnt region to the unburnt region or regions, thereby pre-heating the unburnt region and help establish an even burn. The perforations provide channels for the oxygen to flow.

An intermediate layer or layers of insulation may be provided between the candle or the casing if present and the vacuum jacket. This insulation may be rigid or flexible, for example, of ceramic, rockwool, or particulate material.

The generator according to the invention may be provided with means to blend the oxygen produced with atmospheric air, to deliver oxygen-enriched air, rather than pure oxygen, to a user. The generator may also be provided with an absorbent to absorb any traces of impurities, for example carbon monoxide and chlorine, generated with the oxygen; the copper or brass used as a casing may perform this function also, or additional copper or brass for example, in particulate form, may be provided in the oxygen pathway.

The candle is at least partially contained within a vacuum-jacket vessel. The vessel is advantageously of complementary shape to the candle, to the casing if present, or to the candle and the cylindrical unit described above.

Clearance may be provided between the internal wall of the vessel and the peripheral wall of the candle to allow oxygen to reach the outlet, a spacer or spacers being provided to secure the position of the candle within the vessel. The spacer or spacers may be shaped to provide a tortuous path for the oxygen to follow to allow some cooling before reaching the outlet of the generator. Alternatively the oxygen may all be transmitted through the apertured flat face of the unit if present.

The vacuum-jacket vessel may be of any material capable of withstanding the temperatures reached by the burning candle; a steel, preferably stainless steel, vessel is presently preferred. Alternatively, a robust glass vessel, for example, a borosilicate glass vessel may be used.

A spacing between inner and outer walls of the vessel in the range of from 3 to 5 mm is presently preferred. The vessel is evacuated to provide a high vacuum, advantageously in the range of from $10^{-7}$ to $10^{-5}$ mbar (0.01 to 10 Pa), for example about $10^{-6}$ mbar (0.1 Pa).

In a preferred embodiment of the invention there may be provided, surrounding at least a part of the vacuum jacket, an exterior jacket of thermal insulating material. This may be, for example, of a silicone material, especially a silicone rubber, or other material, e.g., a polymer, having relatively low thermal conductivity and, advantageously, good resistance to elevated temperature. The jacket material may be solid or foamed, and advantageously the surface of the jacket contacting the outer surface of the vacuum vessel is shaped to minimize contact, and hence thermal transmission, between them. The jacket surface may have a raised grid, annuli, or linear pattern. Advantageously, the surface has spaced protuberances or bosses, for example, of cylindrical or hemispherical configuration. It has been found that hemispherical bosses of about 1 mm height and spaced at about 1 mm intervals on a silicone layer of thickness about 2 mm provide an outer surface that in operation reaches a maximum temperature of 45° C.

One oxygen generator constructed in accordance with the invention will now be described by way of example only with reference to the accompanying drawings, in which.

Figure 1:
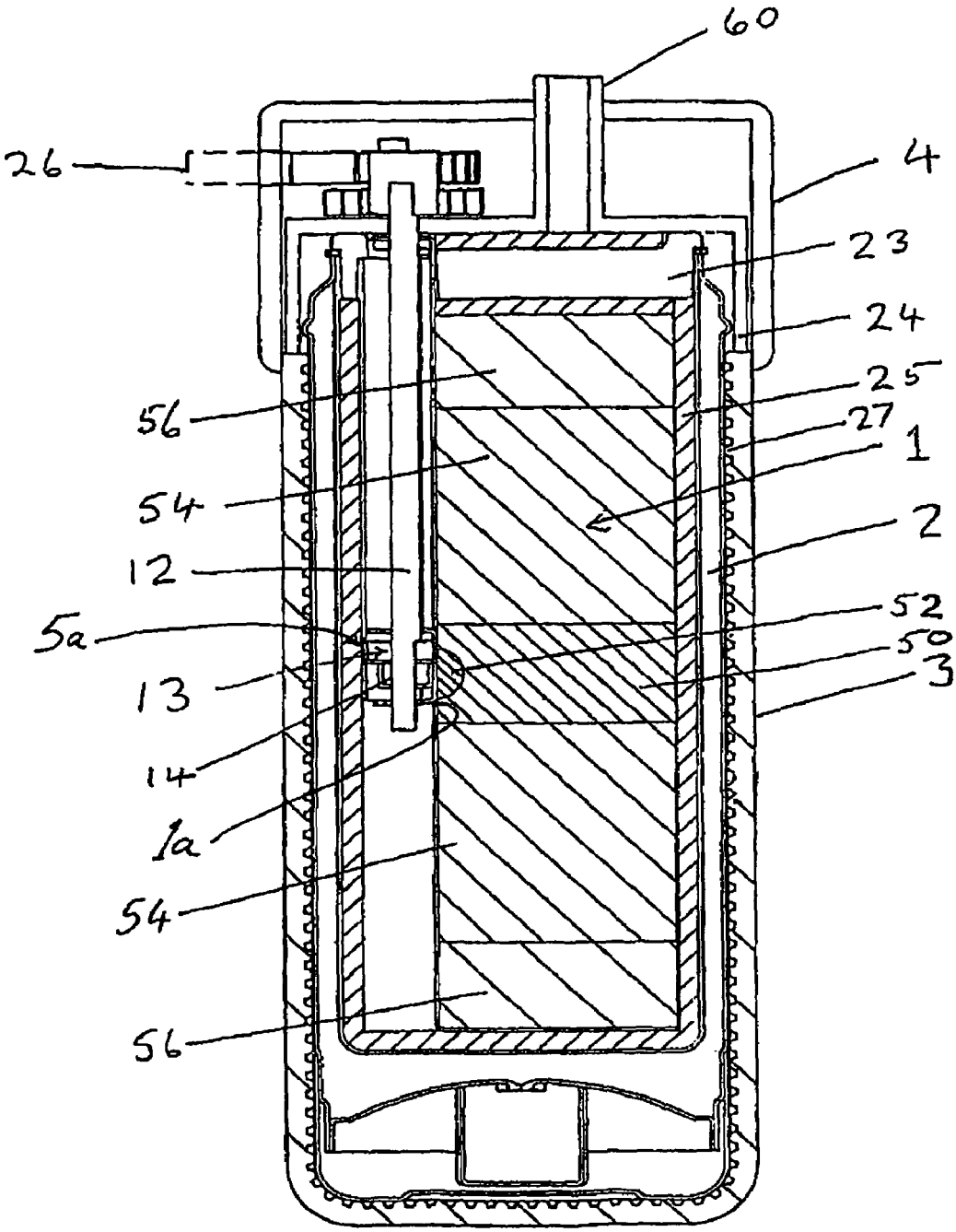
FIG. 1 is an axial section through the oxygen generator.
Figure 2:
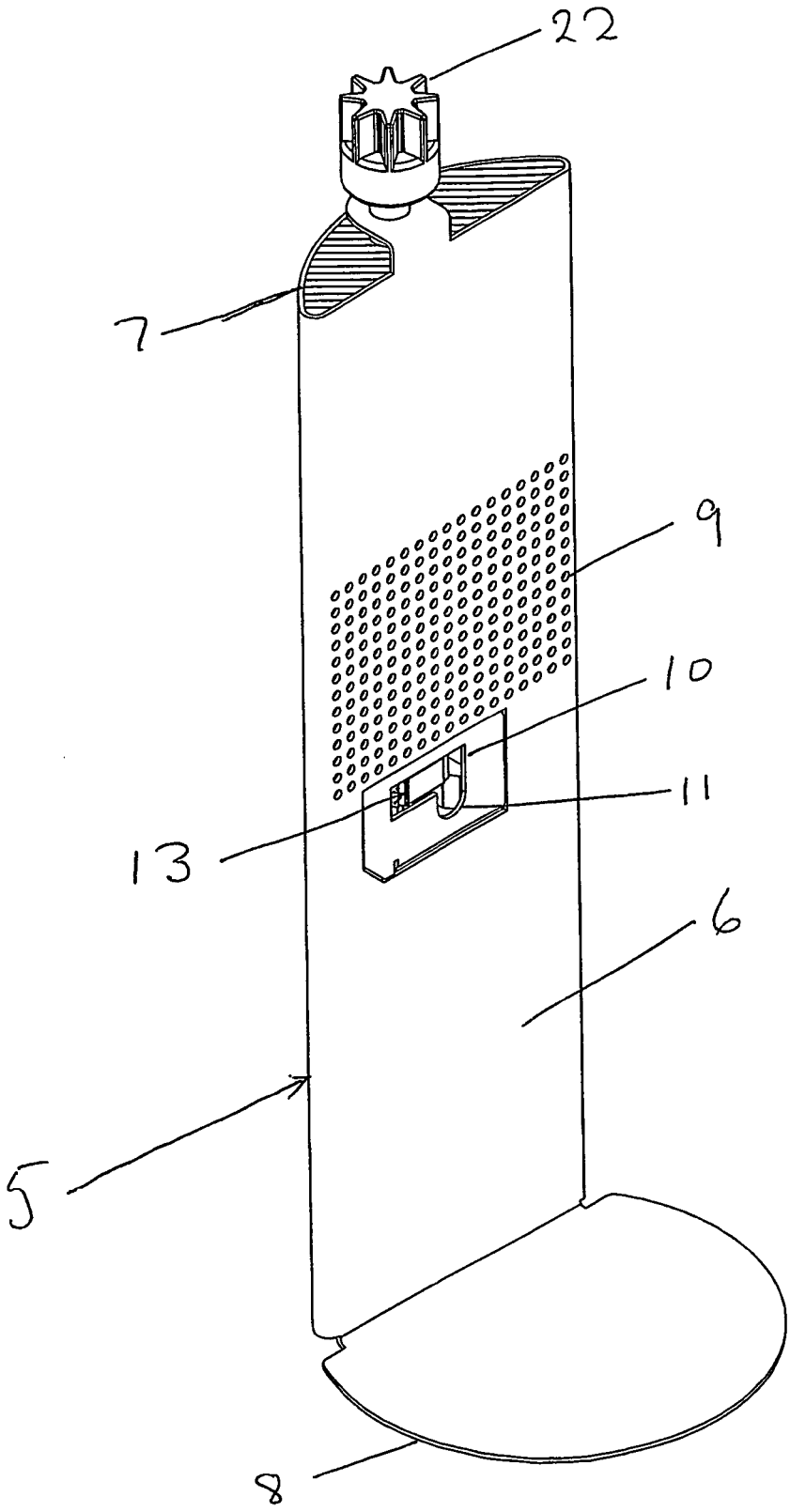
FIG. 2 is an isometric view of the actuator and oxygen transmission unit.

Referring now more especially to FIGS. 1 and 2, there are shown an oxygen candle indicated generally by the reference numeral 1, enclosed other than at its top by a layer of rockwool insulation 25 within a vacuum jacket 2, which is in turn enclosed other than at its top by a further insulating jacket 3 of silicone rubber.

The top of the vacuum jacket 2 is closed by a ceramic plug 23 over which are a cover plate 24 and an outer cap 4.

The insulating jacket 3 contacts the vacuum jacket 2 only at the tips of bosses 27, thereby minimizing heat transmission outward from the candle 1 to the exterior surface of the silicone jacket 3.

Figure 3:
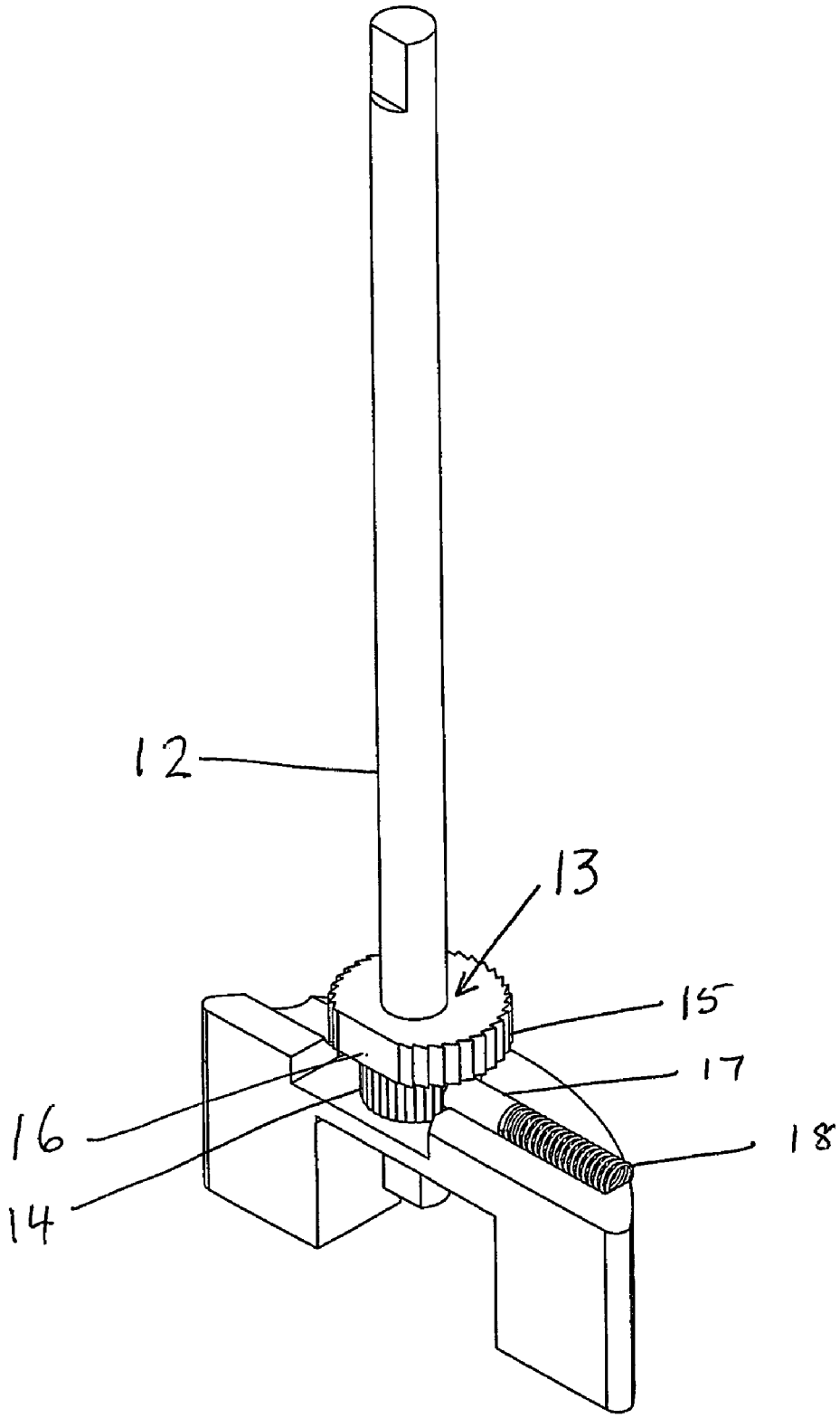
FIG. 3 is an isometric view of the abrader and ignition means.

Also enclosed within the vacuum jacket 2 is a unit indicated generally by the reference numeral 5 (see more especially FIG. 2). The unit 5 has a planar face 6, a part-cylindrical face 7 and a circular base 8, the portion of which extending beyond the bottom (as shown in FIGS. 1 and 2) edges of faces 6 and 7 supports the candle 1. In a mid-upper portion of the planar face 6 are perforations 9, and in the mid-portion of the face 6 is an aperture having an upper rectangular portion 10 and below it a part-circular portion 11. Within the upper portion of the unit 5, supported on bearings (not shown) is a shaft 12, the lower end of which (see more especially FIGS. 3 and 4) carries an ignition means 5*a* including an abrasion wheel indicated generally by the reference numeral 13 and a friction wheel 14. The abrasion wheel 13 has teeth 15 extending around about 300° of its circumference, the remaining 60° segment being cut away to leave a flat surface 16. The teeth 15 are inclined, as in a ratchet wheel, for a purpose explained below.

The friction wheel 14 which is of smaller diameter than the abrasion wheel 13 has a toothed circumference, a portion of which is in contact with a flint 17, pressed against the wheel 13 by a compression spring 18.

Figure 4:
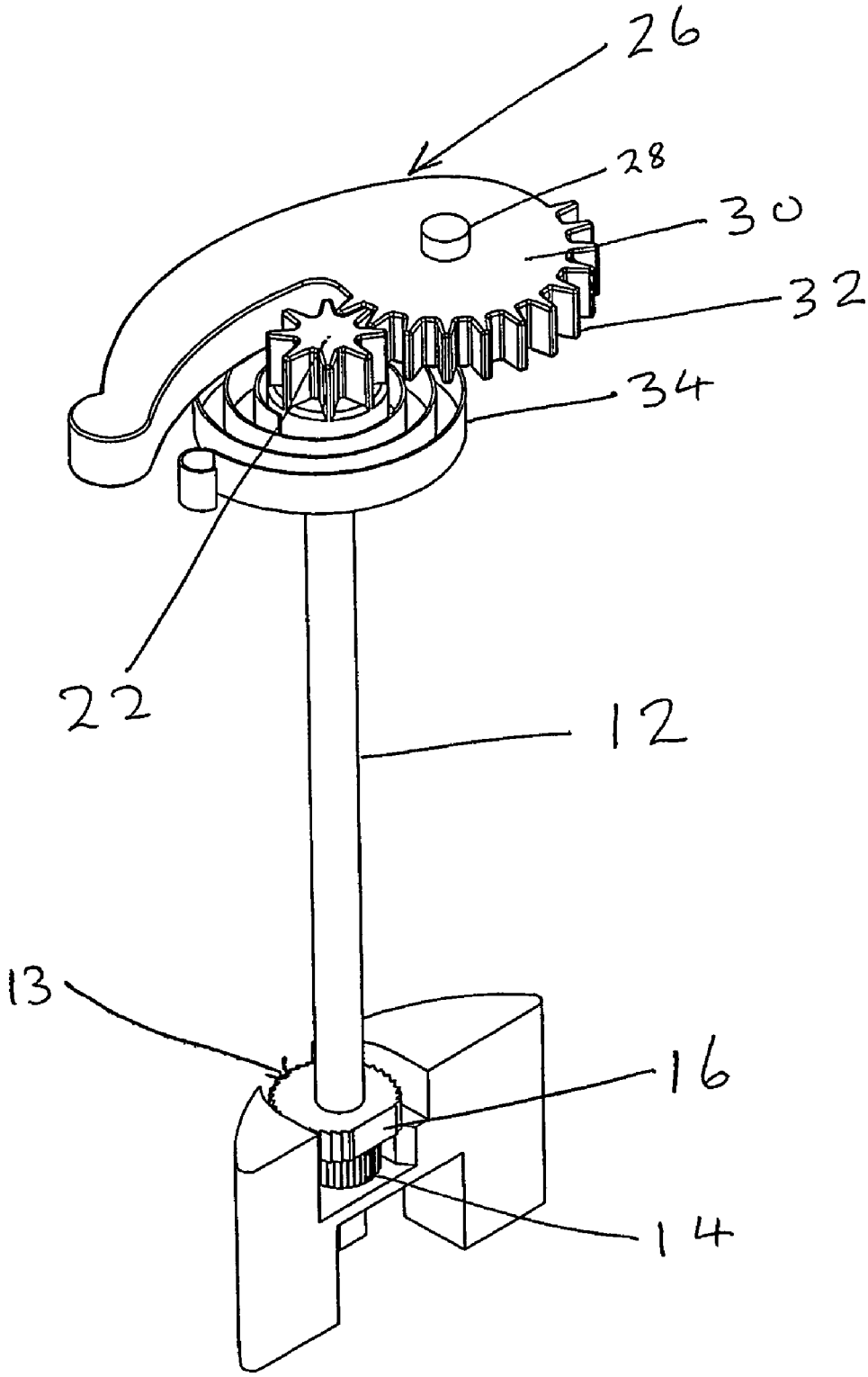
FIG. 4 is an isometric view of the abrader, ignition means and actuator device.

Referring now more especially to FIGS. 4 and 5, there are shown in more detail the actuating means. Mounted on the upper end of the shaft 12 are a gear wheel 22 and the end of a spiral spring 34, the other end of the spring 34 being mounted on a stop (not shown) on a cover plate 24 (see FIG. 1). An operating handle, indicated generally by the reference numeral 26, is mounted on a pivot 28, and has a partially-toothed circular portion 30 coaxial with the pivot, teeth 32 of which circular portion engage the gear wheel 22.

Figure 5A:
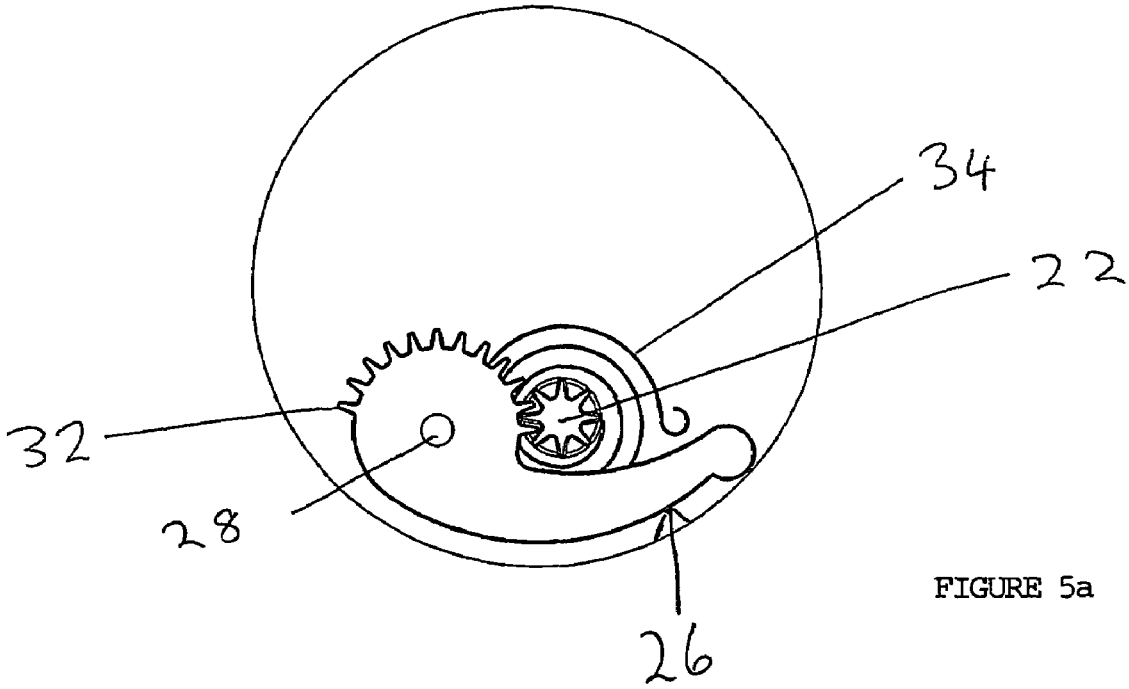
FIGS. 5*a* and 5*b* are diagrammatic plan views of the actuator device.

In FIGS. 4 and 5*a*, the operating handle 26 is shown in its rest or storage position. The forwardmost (clockwise from above as viewed in FIG. 5) of teeth 32 are in engagement with the gear wheel 22, and the flat surface 16 of the abrasion wheel 13 faces, but does not contact, the candle.

Figure 5B:
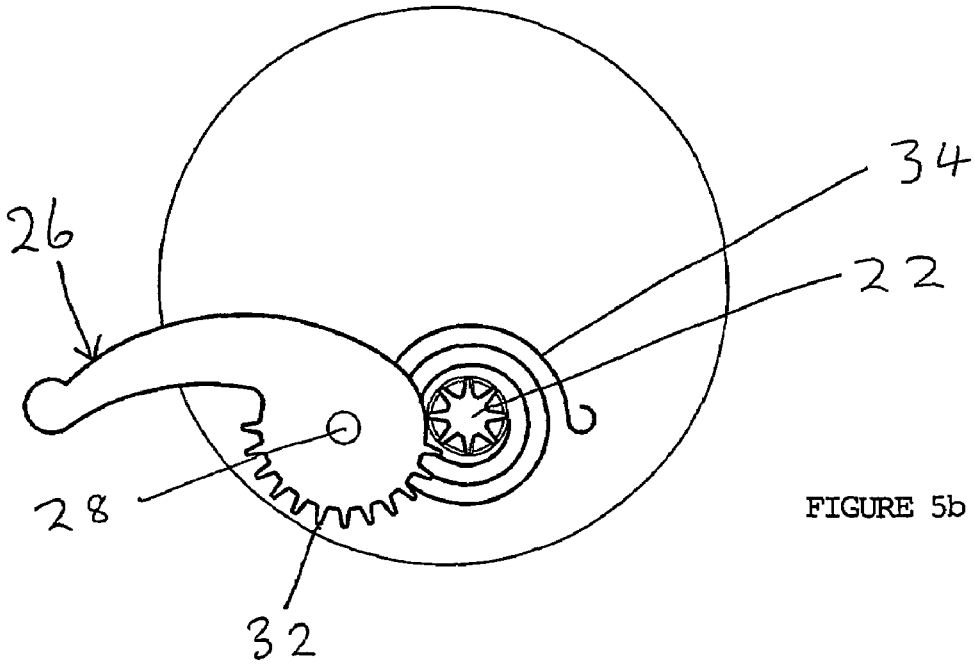

In FIG. 5*b*, the operating handle 26 is shown rotated clockwise by about 180°. The rearmost of teeth 32 are about to disengage from the gear wheel 22 which has been driven anticlockwise against the force of the spring 34, turning the abrasion wheel 13 in the same direction. As the teeth 15 of the abrasion wheel are inclined, they have not abraded the adjacent surface of the candle to any significant extent.

Referring now again to FIG. 1, the candle 1 is in the form of a cylinder having a cross-section other than circular, and advantageously has a cross-section in the form a major segment of a circle. The candle 1 includes a flat surface 1*a* defined by a chord of the circle. The candle 1 has an ignition region, for example, a central element 50 positioned opposite aperture portions 10 and 11 in the unit 5. The element 50 of candle 1 has in the flat surface 1*a* adjacent to the apertures 10 and 11 a hemispherical primer 52 comprising, in addition to the oxygen-supplying material and fuel that are in the remainder of the element 50, an oxidizing agent. Above and below the element 50 are elements 54 having a lower proportion of fuel. More remote from the element 50 than the elements 54 are elements 56 having no fuel.

In operation, the handle 26 is slowly rotated clockwise from the position seen in FIG. 5*a* until the position shown in FIG. 5*b* is reached. By this point, the abrasion wheel 13 has turned so that its teeth 15 are in contact with the material of primer 52. The slow movement of the friction wheel 14 against the flint 17 removes any oxide film from the flint during this operation. Then, disengagement of the teeth 32 takes place, allowing the spring 34 to drive the gear wheel 22 and the shaft 12 rapidly clockwise, causing the forward-facing edges of inclined teeth 15 to abrade the surface of the primer 52. The friction wheel 13 and the flint 17 generate sparks which pass through the aperture 11 and ignite the primer 52 at its newly exposed surface, and/or the dust displaced therefrom, the burn front from the primer igniting the element 50. The burn fronts extend through element 50 and subsequently burn fronts travel through the remaining elements. Oxygen generated by the candle passes into the unit 5 through the perforations 9, and hence through a filter (not shown) to remove any impurities that maybe co-generated, and via outlet 60 to a user.

The following Examples illustrate the invention.

A first oxygen generator constructed in accordance with the invention comprises a sodium chlorate-based candle encased in a copper gauze and delivering 90 litres of USP oxygen at a rate of 6 litres per minute.

The encased candle had a length of 12 cm and a diameter of 3.5 cm, and was encapsulated in insulation material and then in a vacuum flask of length 17 cm, internal diameter 6 cm and external diameter 7 cm. The generator weighed 0.6 kg and had a total length of 17 cm. In operation, the highest temperature reached at the exterior of the flask was 50° C.

A second oxygen generator constructed as described with reference to the drawings and containing a similar candle had outer dimensions, including the silicone jacket, of diameter 6 cm and length 16 cm. In operation, the highest temperature reached at the exterior of the silicone jacket was 45° C.

For comparison, a generator commercially available from Molecular Products Limited and containing an identical candle was tested. The candle was insulated by rockwool and ceramic material. The total weight of the generator was 0.5 kg, its length was 13 cm and its diameter 10 cm. In operation, the highest exterior temperature reached was 150° C.

The invention claimed is:

1. A chemical oxygen generator comprising:

a generating device for producing oxygen by chemical reaction, the generating device having an ignition region; and a friction-induced spark generating ignition device comprising a friction member and flint and an abrader structured and positioned to be effective in abrading a surface of the ignition region to facilitate ignition of the ignition region.

2. A generator as claimed in claim 1, wherein the abrader is structured to be effective to generate ignitable particles at the surface of the ignition region.

3. A generator as claimed in claim 1, wherein the generating device is a solid.

4. A generator as claimed in claim 1, wherein the ignition device is in the form of a cylinder having a flat surface and a cross-section of a major segment of a circle.

5. A generator as claimed in claim 1, wherein the ignition region is located in a central region of the generating device, the generating device being arranged to sustain during operation propagation of a plurality of burn fronts there through, the fronts propagating in generally different directions.

6. A generator as claimed in claim 1 wherein, the generating device being arranged to sustain during operation propagation of two burn fronts traveling in opposite directions and generating oxygen thereby, the device being at least partially enclosed within thermal insulating means comprising a vacuum jacket and thermal insulating material.

7. A generator as claimed in claim 1, wherein the abrader is a part of the friction member.

8. A generator as claimed in claim 1, wherein the ignition region of the generating device includes an oxidizing agent.

9. A generator as claimed in claim 6, wherein the ignition means includes an abrader structured and positioned to be effective in abrading a surface of the ignition region to facilitate ignition of the ignition region.

10. A generator as claimed in claim 1, wherein the generating device is at least partly enclosed within thermal insulating means comprising a vacuum jacket.

11. A generator as claimed in claim 10, wherein the generating device is also at least partially enclosed within thermal insulating material.

12. A generator as claimed in claim 1, wherein the generating device comprises at least one of a metal chlorate and perchlorate, in admixture with a catalyst and a fuel.

* * * * *